US005367770A

United States Patent [19]

McCaughey

[11] Patent Number: 5,367,770

[45] Date of Patent: Nov. 29, 1994

[54] METHOD FOR EMBOSSING INDENTED DOOR LIGHT OPENING EDGE

[75] Inventor: John F. McCaughey, Hamilton, Ohio

[73] Assignee: Masco Industries, Inc., Taylor, Mich.

[21] Appl. No.: 55,389

[22] Filed: May 3, 1993

[51] Int. Cl.[5] ..... B21D 31/00; B21D 22/00; B26D 3/08

[52] U.S. Cl. ..... 29/897.32; 29/465; 29/DIG. 33; 72/389; 83/879

[58] Field of Search ..... 29/243.5, 453, 563, 29/557, 558, 458, DIG. 33, 464, 465, 897, 897.3, 897.312, 897.32; 49/501, 504; 52/306, 309.1, 311, 455, 809; 72/446, 442, 389; 83/49, 879, 880, 916, 917

[56] References Cited

U.S. PATENT DOCUMENTS

| | | | |
|---|---|---|---|
| 3,728,927 | 4/1973 | Pfleiderer et al. | 83/916 X |
| 3,839,936 | 10/1974 | Daniels | 83/916 X |
| 3,878,649 | 4/1975 | Mennuto | 49/501 |
| 3,879,979 | 4/1975 | Arai et al. . | |
| 3,951,026 | 4/1976 | Beauplat | 83/917 X |
| 3,958,053 | 5/1976 | Ryan | 52/306 X |
| 3,987,588 | 10/1976 | Imperial et al. | 49/501 |
| 4,335,296 | 6/1982 | Bredow . | |
| 4,397,117 | 8/1983 | Shipp | 49/501 |
| 4,423,546 | 1/1984 | Scott et al. | 72/446 X |
| 4,590,779 | 5/1986 | Stange et al. . | |
| 4,753,099 | 6/1988 | Klingel | 72/389 |
| 4,856,315 | 8/1989 | Salvagnini | 72/446 X |
| 4,869,141 | 9/1989 | Klingel | 83/49 |
| 4,916,990 | 4/1990 | Dolansky et al. | 83/49 X |
| 4,985,983 | 1/1991 | Otto et al. | 72/446 X |
| 5,018,263 | 5/1991 | Stern | 29/897.312 X |
| 5,022,206 | 6/1991 | Schield et al. | 52/309.9 X |
| 5,029,462 | 7/1991 | Wakahara et al. | 72/389 X |
| 5,072,620 | 12/1991 | Hill et al. | 72/442 X |
| 5,081,891 | 1/1992 | Johnson et al. . | |
| 5,161,343 | 11/1992 | Edwards et al. | 52/311 X |

FOREIGN PATENT DOCUMENTS

| | | | |
|---|---|---|---|
| 1067149 | 6/1954 | France | 49/501 |
| 2949055 | 6/1981 | Germany | 49/501 |
| 425164 | 5/1967 | Switzerland | 49/501 |

*Primary Examiner*—Peter Dungba Vo
*Attorney, Agent, or Firm*—Steven J. Rosen

[57] ABSTRACT

The present invention provides an automated method for forming indented embossed edges around along the periphery of a light aperture for mounting a panel light's pane and frame assembly therein. A panel blank made of sheet metal is mounted on the table of an automated CNC punch press. Next the light aperture is scored in the blank using the punch press to punch out elongated slots between widely spaced apart bridge tabs forming an aperture blank within and connected to the panel blank by the spaced apart bridge tabs. Next the indented embossed edges are formed with two cooperating punch and die sets. A first right angled die set is used to form the four corners. A second straight bar die set is used with an automated nibbling function of the CNC punch press machine to form the linear extending sides of the indented embossed edge. The cooperating punch and die sets are designed to form an edge and not punch through a hole in the blank. The panel is assembled from a front skin and a back skin formed from two such panels and the panel aperture is formed by removing the aperture blanks after the skins have been attached thereby generally forming the shape of the panel. The light assembly is then mounted within the panel aperture.

14 Claims, 5 Drawing Sheets

METHOD FOR EMBOSSING INDENTED DOOR LIGHT OPENING EDGE

BACKGROUND OF THE INVENTION

1. Field of the Invention

This invention relates to method for making light assemblies typically used to mount panes of glass in metal doors, interior and exterior walls or partitions and particularly to means for embossing an indented edge around the opening used to mount a glass pane and surrounding frames in the panel light aperture.

2. Description of Related Art

Light assemblies used to mount glass panes in the apertures of doors, walls, partitions, and similar structures conventionally include a glass pane, typically being of the single or double glazed type, and mounted in a light aperture of the panel between two frames, often referred to as trim. The frames are used to trap the pane between them and are held in place against the outer surfaces of the panel by a clamping assembly that uses cylindrical fasteners such as bolts, rivets, or the like. In the case of U.S. Pat. No. 3,903,669 a rather complicated and expensive double male ended stud is received in bores in the plastic frames which lacks strength and durability. These fasteners require significant assembly time which increases the cost of construction.

Conventional light assemblies and in particular ones used for metal fire doors have frames that protrude outward from the door's outer surfaces and interfere with door hardware that is mounted thereupon. Such hardware includes but is not limited to a flat bar panic device which is mounted transversely across the door and for which it may not be possible, desirable, or safe to place elsewhere particularly in light of handicap related building and housing codes.

A panel light assembly was developed that is flush mounted to the door's outer surfaces so that the frames do not protrude above the outer surfaces and interfere with the mounting of hardware such as a transversely mounted bar like panic device. This panel light assembly and door is the subject of a related patent application Ser. No. 07/991,138 entitled "Door Window Glass and Frame Assembly", by Robert O. Ruff, filed Dec. 16, 1992 and assigned to the same assignee. A feature of panel and more particularly a door is embossed indented edges along the periphery of the light aperture for mounting the light's pane and frame assembly therein.

The door and other panels are conventionally formed from a single blank of sheet metal. The panels are typically formed using conventional sheet metal forming tools in an assembly process that is often highly automated in order to make precise cuts, bends, and folds to insure good fits. Forming the light aperture and its embossed edges poses a serious problem for both the aperture forming steps and the remainder of the panel forming process. The light aperture could not be cut out from the flat blank and the embossed edges formed prior to bending the panel into the final door shape because the aperture would reduce the stability of the panel to a point where it could not easily be processed by conventional machinery in an economical manner. Therefore, a need exists for a method to form the panel and the light aperture with embossed edges before the blank is bent and formed into its final shape and also so that the panel will not have its stability significantly reduced so as to degrade its ability to be formed into a panel. The present invention was developed to provide such a method and to do so in an accurate and efficient manner.

SUMMARY OF THE INVENTION

The present invention provides a preferably automated method for producing panel with a light assembly that has a light aperture with indented embossed edges. The invention is applicable for, but not limited to, use in manufacturing panels such as doors, particularly hollow metal doors, and other types of panels such as interior and exterior walls, room partitions, and the like.

A panel blank made of sheet metal is mounted on the table of an automated CNC punch press. Though not required for the purpose of this invention, the punch press is first used to punch out hardware details such as holes and slots for mounting hardware, such as the lock and hinges, in a conventional manner well known in the industry. Next the light aperture is scored out in outline in the blank using the punch press to punch out elongated slots between widely spaced apart bridge tabs forming an aperture blank within and connected to the panel blank by the spaced apart bridge tabs. Next, with the aperture blank in place, the indented embossed edges are stamped with cooperating punch and die sets and using a conventional nibbling function of the CNC machine.

A first punch and die set has cooperating right angle protrusions and depressions respectively and a second punch and die set has cooperating straight protrusions and depressions respectively. The first set is used to form the embossed corners of the edges and the second set is used to form the embossed linear extending sides of the edge. The cooperating punch and die sets are designed to form an edge and not punch through a hole in the blank. Furthermore, the CNC punch press is operated with a punch force operable form an edge and not punch through a hole in the blank.

First, the embossed edge corners are formed using the first punch and die set having the right angle protrusions and depressions. Next, the second punch and die set is automatically loaded into the press and the CNC punch press is operated using the automated nibbling line function to form the embossed indented edges. After these steps of the method of the present invention have been performed the blank is cut, bent, and otherwise formed into the steel door, sans the light. Then after the panel has been assembled, preferably from a front panel and back panel the aperture blanks are removed thereby forming the light aperture and the indented embossed edges are finished.

The light assembly, including flush mounted front and back frames and glazing therebetween, is then mounted in the blank's aperture within the embossed edges such that the frames are flush with the outer surfaces of the panel. A more particular embodiment of the present invention provides a method of making a panel in the form of a metal door wherein a piece of door hardware such as a bar shaped panic device door release is mounted on an outer surface of the door so as to overlap a portion of one of the frames.

ADVANTAGES

The present invention provides many advantages such as ease of assembly and lower cost as compared to the prior art which requires an expensive and time consuming cutting step to cut out the light aperture blank and an expensive and complicated stamping process to form the indented embossed edge after the blanks were bent and formed into the final panel shape.

BRIEF DESCRIPTION OF THE DRAWINGS

The foregoing aspects and other features of the invention are explained in the following description taken in connection with the accompanying drawings where.

DETAILED DESCRIPTION OF THE INVENTION

Figure 1:
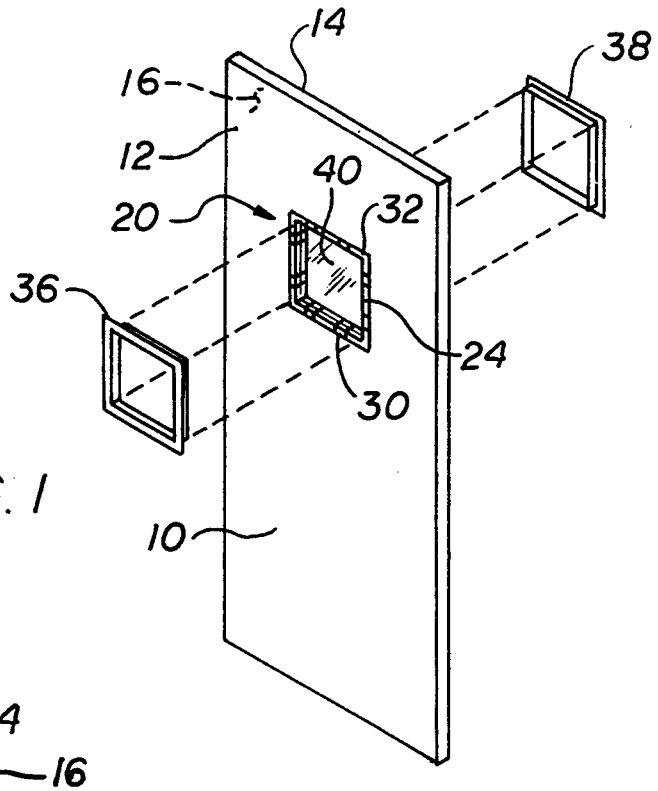
FIG. 1 is a perspective view of a door with a partially exploded view of a light assembly in accordance with one embodiment of the present invention.

The door 10 illustrated in FIG. 1 is an example of a type of panel in the form of a hollow steel door 10 having a panel light assembly 20 produced by a method in accordance with the present invention. The door 10 has a front skin 12 spaced apart from a back skin 14, which are formed from sheet metal by the method of the present invention, and a preferably hollow core 16 therebetween. The terms front and back are arbitrarily assigned for the purpose of clarity in this description and are interchangeable with respect to the skins. The panel light assembly 20 and corresponding panel light apertures 24 in each of the skins 12 and 14 is shown in greater detail in FIG. 2. The panel light assembly 20 uses a spaced apart plurality of retainer clips 30 which are designed to fit over an inwardly (in towards the core) indented embossed edge 32 along periphery 33 of each of the apertures 24. Furthermore the embossed edges 32 are flat and essentially parallel to the remainder of the skins 12 and 14 and to effectively engage the retainer clip 30 and front and back frames 36 and 38 (shown in FIG. 1) respectively which mount and secure the light's glazing 40 which is typically single or double glazed but may have more layers. It is very difficult and expensive to form the apertures 24 and the embossed edges 32. The present invention provides a relatively easy and inexpensive method to form these elements of the panel light assembly 20.

Figure 2:
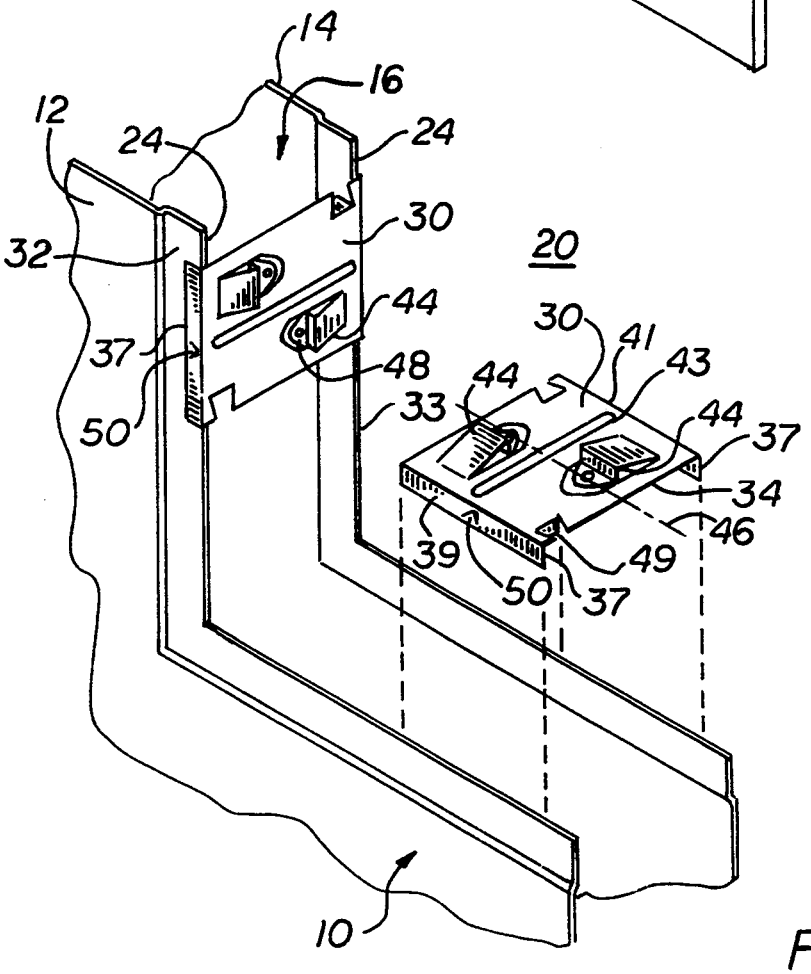
FIG. 2 is an enlarged perspective view of a portion of the light assembly depicted in FIG. 1 showing installation of the retailing clips.
Figure 3:
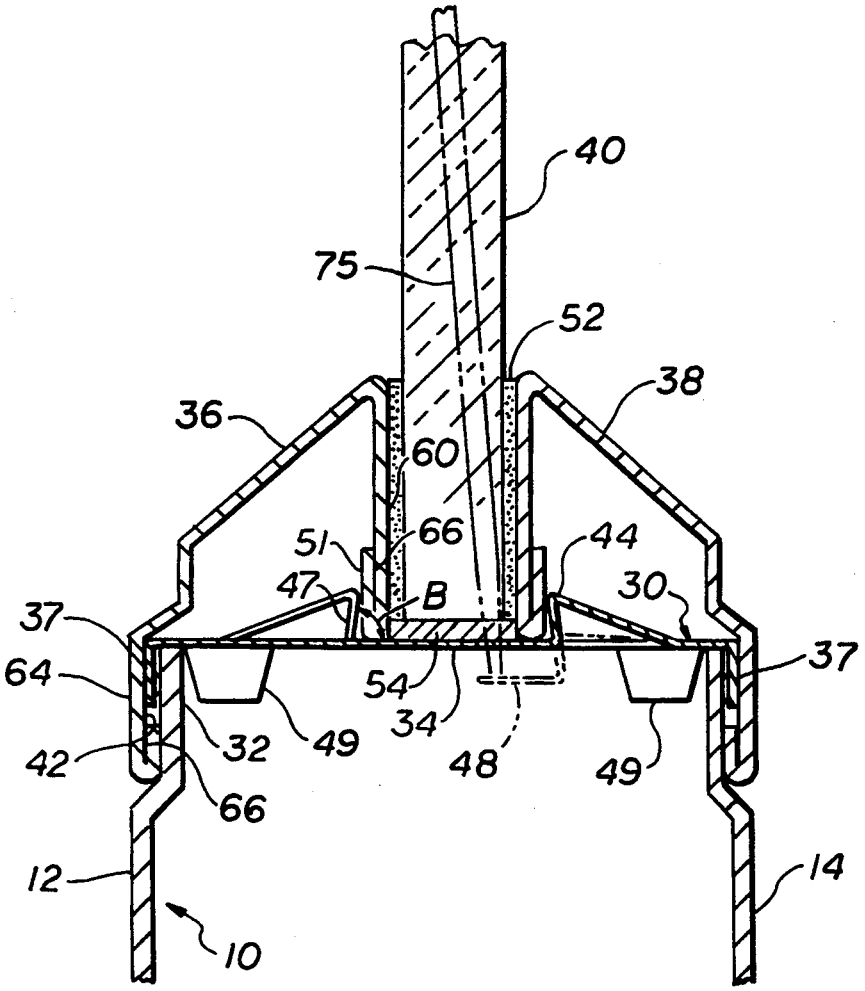
FIG. 3 is a partial sectional view of a portion of the light assembly depicted in FIG. 1.

Referring more specifically to FIGS. 2 and 3, each of the retainer clips 30, constructed preferably of a spring steel, has a clip body 34 and longitudinally extending straight clip legs 37 depending from opposite longitudinal front and back sides 39 and 41 respectively of the clip body 34 such that the clip legs 37 fit flush against the indented embossed edges 32 and do protrude above the outer surfaces of skins 12 and 14. The retainer clip 30 has at least two prongs 44 projecting up from the clip body and generally towards a longitudinal center-line 46 of the clip body 34. A bent extension 47 of the prong 44 and a trim contacting surface 51 on the extension are provided such that the extension makes an angle B facing the longitudinal center-line (46 in FIG. 1) of the clip body 34 and makes an angle B with the clip body that is not more than 90°. A bent over extension 47 of prong 44 at an angle B equal to 85° from the clip body 34 provides an advantageous orientation of the trim contacting surface 51. This prevents the prong 44 from producing a force on the frame 36 away from the clip body 34 that would tend to dislodge the frame from the clip 30.

The prongs 44 are bent up projections cut out from the clip body 34 and have attached to their distal ends a trim release means in the form of release tabs 48 which are further cut out from the clip body. If the glazing 40 is broken it may be removed and then the trim release tabs 48 may be depressed by a simple tool such as a screw driver blade 75 in order to release the frames 36 and 38. Then a new piece of glazing may be installed using the old frames and retainer clips 30.

Referring with particularity to FIG. 2, an inwardly directed barb 50 is disposed on each of the clip legs 37 for securing the retainer clip 30 to the skins 12 and 14. Two skin spacer tabs 49 depend from the clip body 34 and each of the skin spacer tabs is spaced sufficiently apart from the longitudinally extending clip legs 37 so as to be able to hold the skins 12 and 14 between the legs and spacer tabs. A stiffening rib 43 is disposed transversely down the middle of the clip body 34.

Referring more particularly to FIG. 3, each of the frames as illustrated by front frame 36 has an inner frame leg 60 and an outer frame leg 64 with flush bent over walls 66. The frame 36 is secured by a shoulder the prong 44 pushing on the an inner frame leg 60 which in turn puts the frame in tension because the outer frame leg 64 is restrained by the indented embossed edge 32. The flushness of the frame 36 and in particular the outer frame leg 64 with the outer surfaces of skins 12 and 14 is enhanced by the bent over wall 66 being approximately as thin as the clip leg 37 which is received within a channel 42 formed between the outer frame leg 64 and the indented embossed edge 32 as bounded by the bent over walls 66. The combined thickness of the outer frame leg 64 and the bent over wall 66 is equal to or slightly less than the indentation between the outer surfaces of the skins 12 and indented embossed edge 32. The frame 36 need not be flush the outer surfaces of the skins 12 and 14 but preferably should not protrude outwardly beyond these surfaces and fit within the embossment formed by the indented embossed edges 32.

Illustrated more particularly in FIG. 3, is the retainer clip 30 which engages the frames 36 and 38 thereby securing the glazing 40 between the frames. A layer of putty 52 is used between the frames 36 and 38 and the glazing 40. Optional conventional glazing blocks 54 made of rubber loosely disposed between the glazing 40 and the clip bodies 34 may also be used to help center and support the glazing 40. The blocks 54 are usually put on the bottom retainer clips 30 to prevent the glazing 40 from contacting metal but may also be used on the top and vertical sides if so desired. Removal of the light assembly 20 is required usually only to replace the glazing 40 such if it is broken or cracked. The broken remains of the glazing 40 is removed, the putty cleaned away, and the blocks 54 withdrawn. Then the trim release tabs 48 may are accessible to be depressed by the screw driver blade 75 which in turn depresses trim contact surface 51 from engagement with inner wall 66 in order to release the frames 36 and 38.

Figure 4:
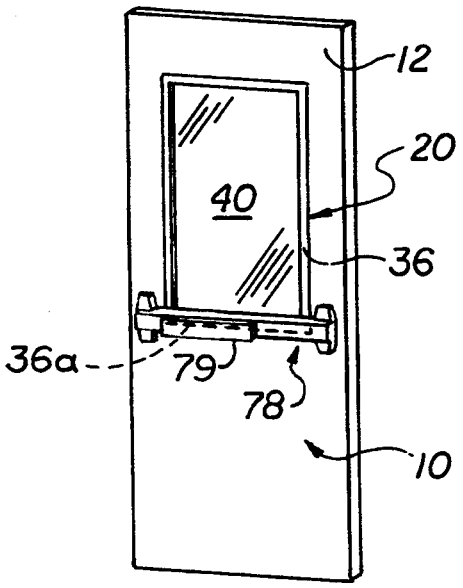
FIG. 4 is a perspective view of a door with a light assembly and panic device mounted on the door in accordance with one embodiment of the present invention.

The door 10 illustrated in FIG. 4 is designed to accommodate people in wheel chairs and the panel light assembly 20 extends low enough on the door to allow people in wheel chairs as well as people standing upright to see through the glazing 40. The panel light assembly 20 has the front frame 36 substantially flush mounted with the doors front skin 12. This allows hardware such as a panic device 78 which includes a button 79 to unlatch the door 10 to be transversely mounted flush against the door 10 on the surface of the front skin 12 and overlap a portion 36A of the frame 36. This enhances the operation of the panic device by allowing the door to accommodate people in both wheel chairs and standing upright in an efficient manner with enhanced ease of operation and for a wide variety of conditions.

The door light assembly discussed above illustrates the need for the method of the present invention for use in constructing a door but other embodiments of the present invention are contemplated for other types of light installations in other types of panels and partitions such as interior and exterior walls of residential, commercial, and industrial buildings. The method of the present invention will now be discussed in more detail.

Figure 5:
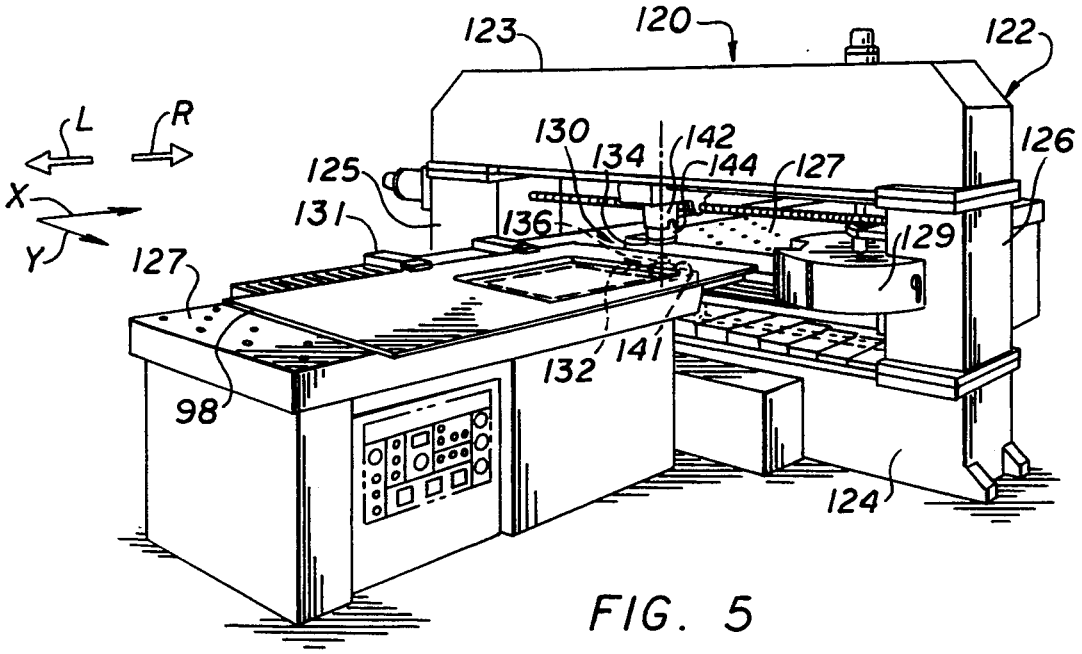
FIG. 5 is a perspective view of a sheet metal panel blank mounted on a table of a CNC punch press illustrating a method for embossing an indented edge along an opening for a door light in accordance with the present invention.
Figure 6:
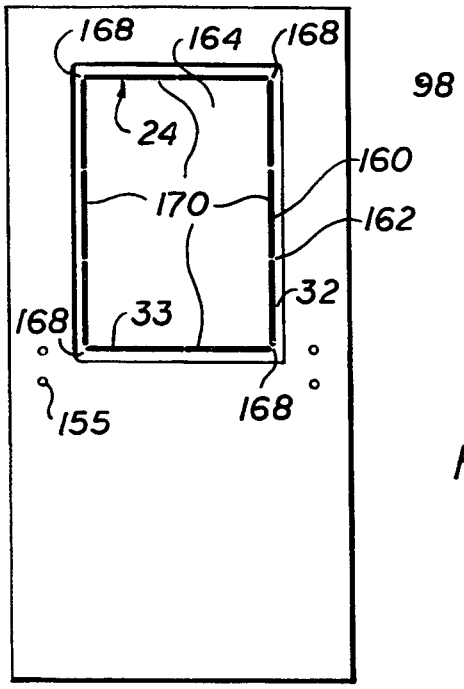
FIG. 6 is an planform view of the panel blank depicted in FIG. 5.

Illustrated in FIG. 5, is a conventional CNC punch press machine 120 which is conventionally used for forming holes in sheet metal. The CNC punch press machine 120 is used by the method of the present invention to form the indented embossed edge 32 along the periphery 33 of each of the aperture 24 of a panel as illustrated in FIGS. 1–4 from a sheet metal panel blank 98. The machine 120 includes a main support or frame 122 which has an overhead bridge 123, mounted to an underlying base 124 by a first column 125 and a second column 126 extending between the base and the bridge and which support the overhead bridge 123. The various frame members define a large and generally rectangular opening or throat 130 within which a portion of the panel blank 98 is located and within which the punching operation of the present invention takes place. Tables 127 are disposed on opposite sides of the frame to support the panel blank 98, there being additional table structure 128 within the throat 130. The punch press machine 120 is preferably an automatic tool changing press that it includes a magazine 129 which holds several sets of tools with each punch and die set 132 such as that used in the present invention including a cooperating punch 134 and a die 136. Typically a vertically reciprocating ram 142, whose lower end carries a punch holder 144, is operably supported by the bridge 123 of the frame 122. The punch 134 is adapted to be locked releasably in the punch holder 144. A die holder 141 located directly below the ram 142 is adapted to releasably receive and hold the die 136. When a given punch operation is completed, the punch and die in the punch and die holders 144 and 141 respectively are adapted to be automatically removed therefrom and automatically replaced with a different punch and die set from the magazine 129 so that a different punching operation may be performed.

The panel blank 98 is conventionally mounted and held by the machine 120 to be shifted laterally (i.e., to the left L or right R as viewed in FIG. 5) on the tables along an X-axis by clamps 131 which grip the panel blank 98. The clamps 131 are operable to move the panel blank 98 along the X-axis. Aligned vertically with the punch 134 is the cooperating die 136 which is suitably sized and shaped to coact with the punch to form the indented edge in the panel blank 98 when the punch is shifted downwardly. The machine 120 is operable to move the punch 134 and the die 136 relative to the panel blank 98 and may be located to form the indented embossments holes in various positions along the Y-axis. As a result, it is not necessary to move the panel blank 98 along the Y-axis only along the X-axis.

Figure 8:
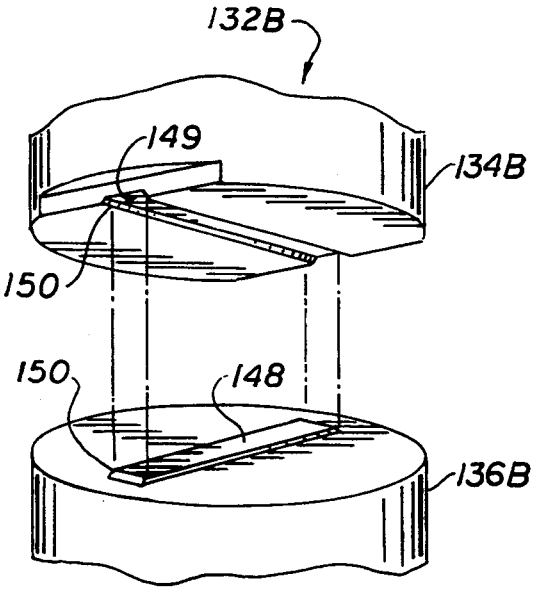
FIG. 8 is a is a partially exploded perspective view of a second punch and die set for use in a CNC punch press according to one method for embossing an indented edge along an opening for a door light of the present invention.
Figure 7:
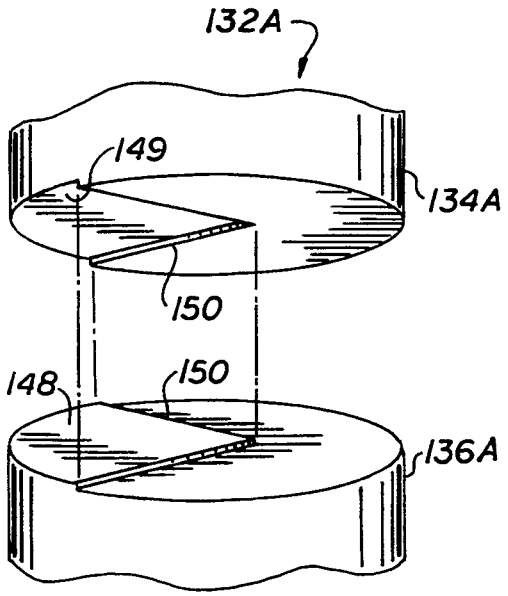
FIG. 7 is a is a partially exploded perspective view of a first punch and die set for use in a CNC punch press according to one method for embossing an indented edge along an opening for a door light of the present invention.
Figure 9:
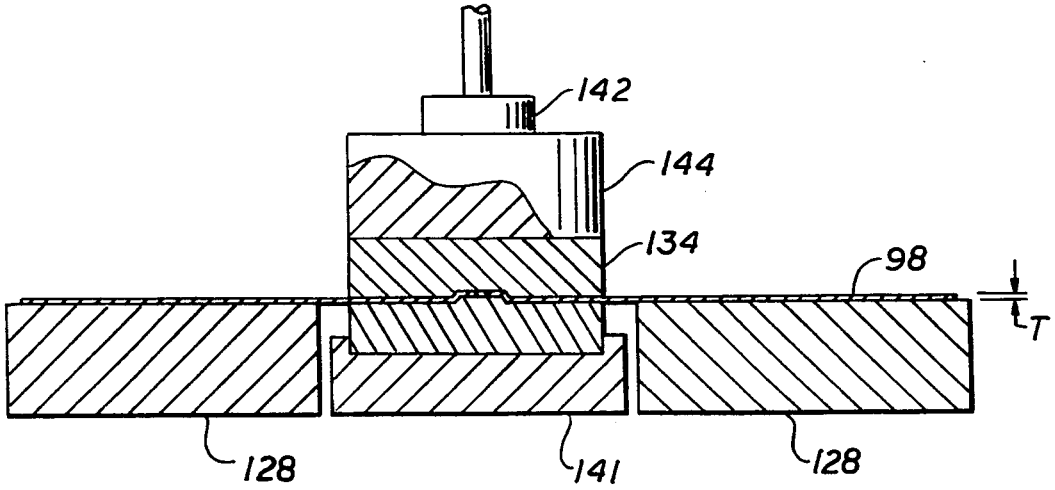
FIG. 9 is a cross-sectional view of a punch and die set relative to the sheet metal panel and CNC punch press FIG. 5.

The method of the present invention is further enhanced by the automatic tool changing features of the machine 120 so that two different punch and die sets 132 may be used. A first punch and die set 132A, illustrated in FIG. 7, is provided to form the corners of the indented embossed edge 32. A second punch and die set 132B, illustrated in FIG. 8, is provided to form the straight portions of the indented embossed edge 32 using a conventional CNC automated nibbling function. As illustrated in FIG. 9, the present invention provides first and second punches 134A and 134B respectively and cooperating first and second dies 136A and 136B with features having appropriate dimensions to accommodate the thickness T of the panel blank 98 so that when the ram 142 is shifted downwardly, the punch 134 moves downwardly to form the indented embossed edge 32 in the panel blank 98 by bending or stamping the sheet metal instead of punching a hole through the panel blank 98. Important features of first and second punches 134A and 134B and cooperating first and second dies 136A and 136B are their mating protrusions 148 and depressions 149. Protrusions 148 and depressions 149 are provided with slanted sidewalls 150 and clearances between the protrusions 148 and depressions 149 to accommodate the thickness T of the panel blank 98.

Having thus described the equipment and its use in the method of the present invention the steps of the preferred embodiment will now be described in more detail. Referring to FIG. 5, the panel blank 98, preferably made of sheet metal and typically about 16 or 18 gauge, is mounted on the table 127 of the automated CNC punch press machine 120. Using the punch press machine 120, hardware details as exemplified by holes 155 for mounting hardware, such as the panic device 78 (in FIG. 4) and others for locks and hinges (not shown), are preferably punched out in a conventional manner using conventional punch and die sets as is well known in the industry. Next the light aperture 24 (in FIG. 4) is outlined or scored out in the panel blank 98 using the punch press machine 120 to punch out elongated slots 160 between widely spaced apart bridge tabs 162 form-ing an aperture blank 164 within and connected to the panel blank by the spaced apart bridge tabs. An exemplary slot may be about 8–12 inches long and a corresponding bridge tab is about 0.25 inches long. Next the indented embossed edge 32 along the periphery 33 of the aperture 24 is formed with the first and second punch and die sets 132A and 132B respectively.

The first punch and die set 132A has a right angle protrusion 148 and a right angle depression 149 and the second punch and die set 132B has a straight protrusion 148 and a straight depression 149. The first punch and die set 132A is used to form the embossed corners 168 of the indented embossed edge 32. Next, the second punch and die set 132B is automatically loaded into the machine 120 and used to form the linear extending sides 170 of the indented embossed edge 32 by using an automated nibbling line function, that is well known in the art, to form the linear extending sides 170 of the indented embossed edge 32. The machine 120 is operated in conjunction with the first and second punch and die sets 132A and 132B to form the indented embossed edge 32 such that it is outside of the aperture blank 164 and bounded by the elongated slots 160. Later on in the process after the panel blanks 98, typically two in number, are formed into a panel shape the spaced apart bridge tabs 162 are removed thereby releasing the aperture blank 164 within and forming the light aperture 24. To further prevent the machine 120 from punching a hole through the panel blank 98 the CNC punch press machine 120 is operated with a punch force which will only form an indentation or stamped edge and not punch a hole through the panel blank.

Figure 10:
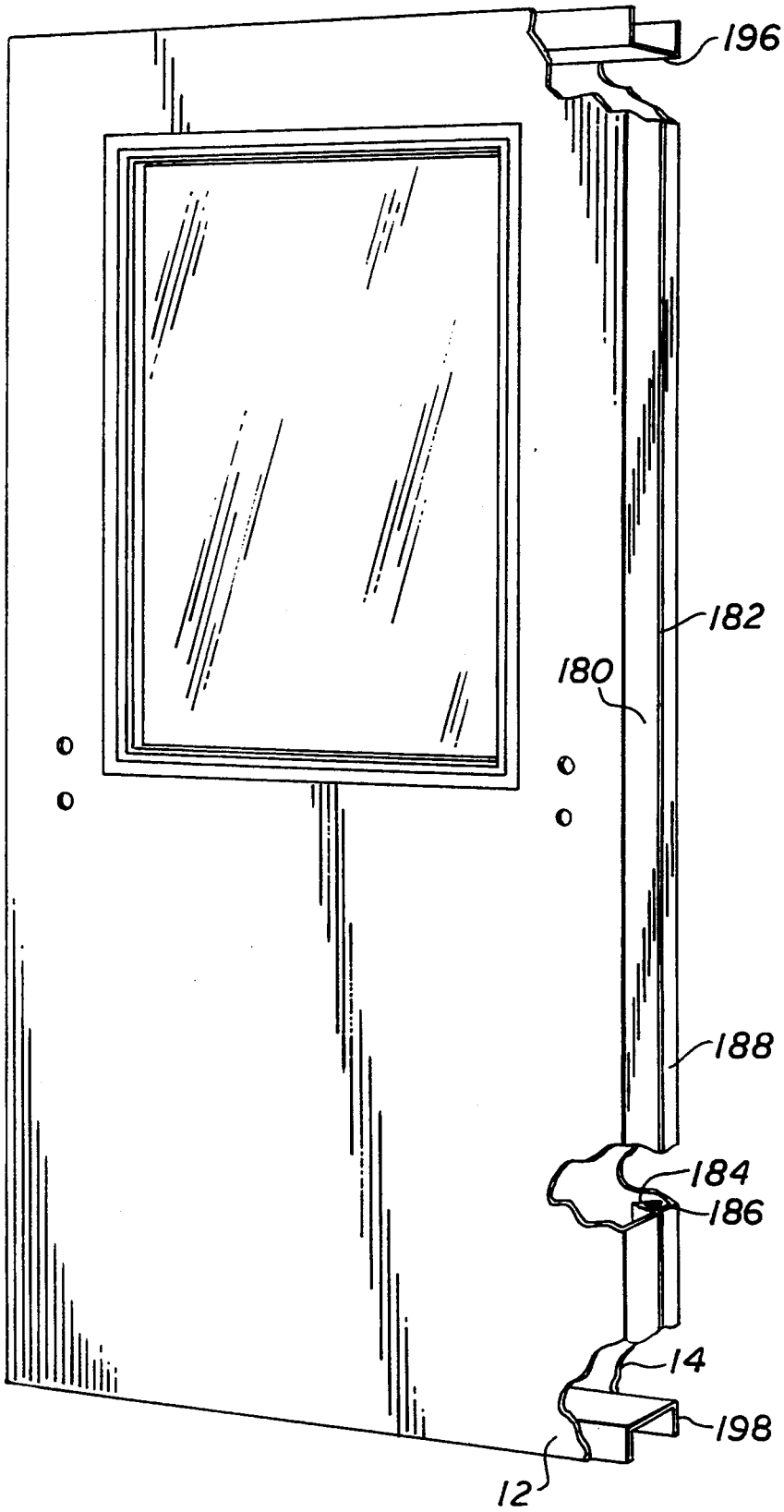
FIG. 10 is a partial cut-away perspective view of a steel door assembly made with in accordance with one embodiment of the method of the present invention.

After these steps of the method of the present invention have been performed the panel blanks are cut, bent, and otherwise formed into the front skin 12 and back skin 12 of a panel such as the steel door 10 in FIG. 4, sans the panel light apertures 24. Referring to FIG. 10, the door 10 is assembled using the front skin 12 which has first sides 180, formed from a bent edge of a panel blank 98, and a first hook 184, also formed by bending a portion of the panel blank. The first hook 184 is used to engage a cooperating second hook means 186 of the back skin 14 to form a seam 182. The second hook means 186 similarly is formed in a second side 188 of the back skin 14 by bending a portion of a panel blank 98 used to make the back skin. A top C channel 196 and a bottom C channel 198 are welded between the front skin 12 and the back skin 14 for strength and rigidity. The panel light apertures 24 are then formed by cutting away the bridge tabs 162 and removing the aperture blank 164.

The light assembly, including flush mounted front and back frames and glazing therebetween, is mounted in the panel light apertures within the embossed edges such that the frames are flush with the outer surfaces of the panel. A more particular embodiment of the present invention provides a method of making a panel in the form of a metal door wherein a piece of door hardware such as a bar shaped panic device door release is mounted on an outer surface of the door so as to overlap a portion of one of the frames.

While the preferred embodiment of the present invention has been described fully in order to explain its principles, it is understood that various modifications or alterations may be made to the preferred embodiment without departing from the scope of the invention as set forth in the appended claims.

I claim:

1. A method for producing a panel having a light assembly aperture with embossed indented edges around a periphery of the aperture, said method comprising the following steps:

scoring out an outline of a light assembly aperture in a panel blank, thereby forming an aperture blank interior of the scored outline and aperture edges surrounding the aperture blank and the outline, forming an indented embossment along the aperture edges of the aperture along and exterior to the scored outline by mounting the panel blank having said aperture therein in an automated numerically controlled punch press machine having at least one cooperating die and punch set operatively mounted therein, and operating the machine using the one cooperating die and punch set in an automated nibbling function along the aperture edges to form the embossment with embossed indented aperture edges of the light assembly aperture.

2. A method as claimed in claim 1 wherein the step comprising scoring out an outline of the light aperture further comprises mounting the panel blank into the machine before the step using the nibbling function and using the machine to form the scored outline.

3. A method as claimed in claim 2 wherein the scored outline is made of linearly disposed elongated slots with short tabs in between which connect the aperture blank to the remainder of the panel blank exterior of the scored outline.

4. A method as claimed in claim 3 further comprising:

forming the indented embossed edge of the light aperture using at least two cooperating die and punch sets wherein;

a first punch and die set, having cooperating right angle protrusions and depressions respectively, is used to form right angle indented embossed edge corners; and a second punch and die set having cooperating straight protrusions and depressions respectively is the one cooperating die and punch set used in the automated nibbling function to form straight indented embossed edge sections.

5. A method as claimed in claim 4 wherein said first and second punch and die sets have cooperating first and second dies with mating protrusions and depressions, the mating protrusions and depressions have slanted sidewalls, clearances are provided between the mating protrusions and depressions to accommodate the thickness of the panel blank during the punching process, and the machine, while using said first and second punch and die sets, is operated with a sufficient punch force which will form an indentation and not punch a hole through the panel blank.

6. A method as claimed in claim 5 further comprising: forming the panel blank including bending portions of the panel blank and then assembling a panel using at least one of said panel blanks and forming a light assembly aperture in the panel by removing the aperture blank.

7. A method as claimed in claim 5 further comprising:

forming a first and second panel blank according to the method as claimed in claim 4, forming a front panel skin from the first panel blank and a back panel skin from the second panel blank, forming panel sides on the front skin by bending side portions of the first panel blank and forming a first hook attachment means by bending the edges of the side portions of the first panel blank, forming a second hook attachment means by bending the side edges of the second panel blank so that the first and second hook attachment means cooperate to attach the back skin to the front skin to form the panel, and then assembling the panel by attaching the back skin to the front skin and forming a light assembly aperture by removing the aperture blanks from the back skin and the front skin.

8. A method as claimed in claim 7 further comprising:

installing a light assembly including a glazing between front and back frames in the light assembly aperture within the indented embossed edges such that the frames are flush with outer surfaces of the panel from which the indented embossed edges are indented inwardly thereof.

9. A method for producing a steel door having a door light, said method comprising:

forming a front skin and a back skin wherein each skin is made from a piece of suitable gauge sheet metal in the form of a panel blank and each panel blank is formed by the following steps:

scoring out an outline of a light aperture in the panel blank, thereby forming an aperture blank interior of the scored outline and aperture edges surrounding the aperture blank and the outline, forming an indented embossment along the aperture edges of the light aperture along and exterior to the scored outline by mounting the panel blank having said aperture therein in an automated numerically controlled punch press machine having at least one cooperating die and punch set operatively mounted therein, and operating the machine using the one cooperating die and punch set in an automated nibbling function along the aperture edges to form the embossed indented edges;

then assembling the door by attaching the back skin to the front skin and forming a door light assembly aperture by removing the aperture blank from each of the front and back skins.

10. A method as claimed in claim 9 further comprising:

forming the indented embossed edge of the light aperture using at least two cooperating die and punch sets wherein;

a first punch and die set, having cooperating right angle protrusions and depressions respectively, is used to form right angle indented embossed edge corners; and a second punch and die set having cooperating straight protrusions and depressions respectively is the one cooperating die and punch set used in the automated nibbling function to form straight indented embossed edge sections.

11. A method as claimed in claim 10 wherein said first and second punch and die sets have cooperating first and second dies with mating protrusions and depressions, the mating protrusions and depressions have slanted sidewalls, clearances are provided between the mating protrusions and depressions to accommodate a thickness of the panel blank during the punching process, and the machine, while using said first and second punch and die sets, is operated with a sufficient punch force which will form an indentation and not punch a hole through the panel blank.

12. A method as claimed in claim 11 further comprising:

installing a light assembly including a glazing between front and back frames in the light assembly aperture within the indented embossed edges such that the frames are flush with outer surfaces of the panel from which the indented embossed edges are indented inwardly thereof.

13. A method as claimed in claim 12 wherein the scored outline is made of linearly disposed elongated slots with short tabs in between which connect the aperture blank to a remainder of the panel blank exterior of the scored outline.

14. A method as claimed in claim 13 wherein the step comprising scoring out an outline of the light aperture further comprises mounting the unscored panel blank into the machine and using the machine to form the scored outline.

* * * * *